US010724279B2

(12) United States Patent
Wilke

(10) Patent No.: US 10,724,279 B2
(45) Date of Patent: Jul. 28, 2020

(54) PIVOTING DEVICE FOR A MOTOR VEHICLE WITH EASY-TO-INSTALL AND SAFER PIVOT BEARING

(71) Applicant: ILLINOIS TOOL WORKS INC., Glenview, IL (US)

(72) Inventor: Zsolt Wilke, Bad Mergentheim (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 351 days.

(21) Appl. No.: 15/554,358

(22) PCT Filed: Mar. 24, 2016

(86) PCT No.: PCT/US2016/023860
§ 371 (c)(1),
(2) Date: Aug. 29, 2017

(87) PCT Pub. No.: WO2016/164172
PCT Pub. Date: Oct. 13, 2016

(65) Prior Publication Data

US 2018/0051497 A1 Feb. 22, 2018

(30) Foreign Application Priority Data

Apr. 8, 2015 (EP) ..... 15162733

(51) Int. Cl.
*E05B 85/12* (2014.01)
*E05D 7/10* (2006.01)
*E05B 85/16* (2014.01)

(52) U.S. Cl.
CPC ..... *E05B 85/12* (2013.01); *E05B 85/16* (2013.01); *E05D 7/10* (2013.01); *E05D 7/1005* (2013.01); *E05D 7/1022* (2013.01); *E05D 7/1055* (2013.01)

(58) Field of Classification Search
CPC ..... E05B 85/12; E05B 85/14; E05B 85/16; E05B 85/18; E05D 7/1022; E05D 7/1055;
(Continued)

(56) References Cited

U.S. PATENT DOCUMENTS 6,099,097 A * 8/2000 Hocker ..... G06F 1/181 16/225
2005/0134058 A1* 6/2005 Belchine, III ..... E05B 85/12 292/336.3

(Continued)

FOREIGN PATENT DOCUMENTS

CN 103711388 4/2014
DE 9303263 5/1993

(Continued)

OTHER PUBLICATIONS

PCT, International Search Report and Written Opinion, International Application No. PCT/US2016/023860; dated May 31, 2016, 11 pages.

*Primary Examiner* — Nathan Cumar
(74) *Attorney, Agent, or Firm* — Thompson Hine LLP

(57) ABSTRACT

Pivoting device (1) for a motor vehicle has a holder (50) and a pivoting body (10) which is mounted on the holder (50) via an articulated mounting (31) so as to be pivotable about a pivot axis (12), wherein the pivoting body (10) and the holder (50) are held together by a snap fastening between at least two articulation elements (33.1, 33.2, 34.1, 34.2) of the articulated mounting (31), and the pivoting device (1) has a blocking element (40). A closing or release of the snap fastening is possible in at least one first angular position of the pivoting body (10) in relation to the holder (50) and the closing or release of the snap fastening is blocked in at least one second angular position by a relative movement of the two articulation elements (33.1, 33.2, 34.1, 34.2) being
(Continued)

Figure 1A:
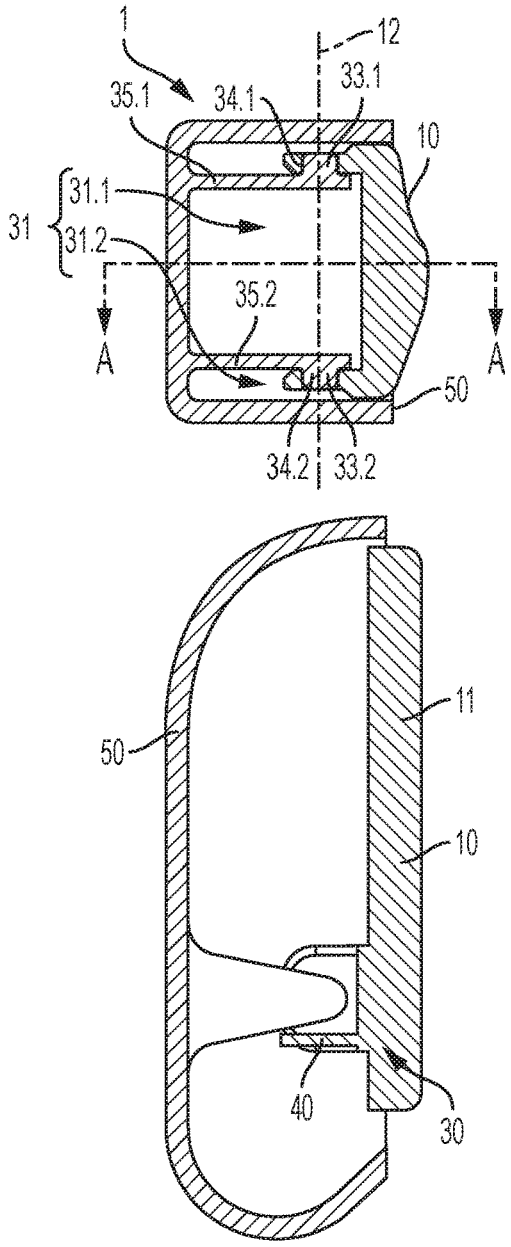

blocked in a form-fitting manner by the blocking element (40).

20 Claims, 3 Drawing Sheets

(58) Field of Classification Search
CPC ... E05D 7/1005; E05D 7/1011; E05D 7/1016; E05D 5/12; E05D 15/50
USPC ..... 292/336.3
See application file for complete search history.

(56) References Cited

U.S. PATENT DOCUMENTS

| | | | | |
|---|---|---|---|---|
| 2010/0171324 | A1* | 7/2010 | Stapf | B29C 45/0017 292/336.3 |
| 2014/0096576 | A1 | 4/2014 | Jens | |
| 2015/0225988 | A1* | 8/2015 | Kammerbauer | E05B 85/16 292/336.3 |

FOREIGN PATENT DOCUMENTS

| | | |
|---|---|---|
| DE | 102006053250 | 5/2008 |
| EP | 0578920 | 1/1994 |
| JP | S6299575 | 5/1987 |
| JP | 2001207695 | 8/2001 |

* cited by examiner

PIVOTING DEVICE FOR A MOTOR VEHICLE WITH EASY-TO-INSTALL AND SAFER PIVOT BEARING

The invention relates to pivoting devices for motor vehicles, with a pivoting body which is pivotable in relation to a holder, for example as part of a door handle device for vehicles, in particular inside door handle device, with which a lock of a vehicle door can be operated and which has a door handle, which is configured as a pivoting body, with a handle section to be pivoted manually, or, for example, for use in the case of a door or for other flaps (e.g. tailgate of a pick-up) or storage compartment coverings, e.g. in the commercial vehicle sector (e.g. luggage covering flap) or in the passenger car sector (e.g. sunglasses compartment flap).

In the prior art, the pivoting bodies are customarily fastened pivotably to a holder by means of a retrospectively inserted spindle, but this is considered disadvantageous since the installation is thereby complicated, which can be readily understood with reference to the example of such inside door handles. In this field, it has been proposed, as an improvement, in DE 102006053250 A1, which relates to an inside door handle, to form the entire assembly of handle, holder and spindle as a unit by two-component injection molding from plastic, wherein the plastics selected are structured in such a manner that the parts movable relative to one another are not connected to one another during the injection molding. The inventor attempted to achieve simpler installation of pivoting devices in another manner.

It is the object of the present invention to provide an easy-to-install and safe bearing of the pivoting body. The object is achieved by the independent claims. Advantageous developments are defined in the dependent claims.

In particular the object is achieved by a pivoting device for a motor vehicle, which has a holder and a pivoting body which is mounted on the holder via an articulated mounting so as to be pivotable about a pivot axis, wherein the pivoting body and the holder are held together on the articulated mounting by means of a snap fastening between at least two articulation elements of the articulated mounting, and the pivoting device has a blocking element, wherein a closing or release of the snap fastening is possible in at least one first angular position, or preferably an angular region, of the pivoting body in relation to the holder and the closing or release of the snap fastening is blocked in at least one second angular position, or preferably a second, different angular region, by a relative movement of the two articulation elements being blocked in a form-fitting manner by the blocking element, which relative movement is necessary for releasing the snap fastening.

By this means, the pivoting body can easily be installed by the pivoting body being guided in the holder in the first angular position and then the snap fastening closing. At the same time, in the second angular position, the device is secured against inadvertent release by the snap fastening, which could be released inadvertently, by means of the blocking element. The second angular position here is preferably and expediently a position which arises when a user pulls on the pivoting body and a large pivoting torque acts on the bearing, for example the angular position when a pivoting body (end stop) is completely pivoted out. The first angular position is preferably the angular position which corresponds to the inoperative position of the pivoting body in the assembled state, or even a position which is removed even further from the end stop, and therefore the rest position is located between the first angular position and the end stop. For example, a spring could be present which presses the pivoting body from the first angular position in the direction of the inoperative position and end stop, and therefore the first angular position has to be brought by means of application of force during the installation into the first angular position. The first angular position is preferably the installation position. The two angular positions can also be angular regions which do not overlap. The angular position relates in each case to an angle of rotation of the pivoting body relative to the holder about the pivot axis.

The pivoting body is preferably composed of a plastic. It is preferably formed as a single piece. In addition to the configuration also mentioned subsequently, as a door handle, the pivoting body can be configured, for example, as a (covering) flap or pivoting door (see, for example, tailgate of a pick-up, luggage covering flap, sunglasses compartment flap, glove compartment flap). The pivoting body preferably has a pivoting region which is bounded by two stops.

Snap fastening is preferably understood as meaning a connection which is characterized by a releasable form-fitting engagement with cooperation of an elastic element. In the inoperative state, the elastic element takes up a position corresponding to the form-fitting engagement, but is reversibly deformable, for example bendable, elastically into an enabling position for the release or for the installation.

The fact that the blocking element blocks a relative movement in a form-fitting manner is preferably understood as meaning that the blocking element, by means of the physical existence thereof, impedes a free relative movement to the extent necessary for releasing the snap fastening—it is therefore entirely possible for a movement clearance to remain.

The one articulation side (for example holder side) preferably has a mating surface which, in the assembled state of the device, is arranged axially next to the articulation element of the other articulation side (for example pivoting-body side). The articulation element of the other articulation side is therefore preferably arranged axially between the mating surface and a holding element of the articulation element of the first articulation side. The mating surface allows the articulation element of the other articulation side less axial clearance than is necessary for releasing the snap fastening by an axial movement of the articulation element of the other articulation side (pivoting-body side). This provides security against, for example, bending of the other articulation side, and therefore the necessary movement for opening/closing the snap fastening is undertaken substantially only on the first articulation side (for example holder side). The mating surface is preferably designed in the form of a projection. The projection, as seen from the side from which the pivoting body is brought up to the holder in order to join together the snap fastening, is preferably arranged further to the rear than the holder-side articulation element or behind the holder-side articulation element, at the same height as the holder-side articulation element. By this means, an aid for introduction of the pivoting body into the holder is provided by the projection. The second bearing region is preferably configured analogously. The one articulation side can also be the pivoting-body side and the other articulation side is then correspondingly the holder side.

In a further exemplary embodiment of the present invention, the pivoting device is a door handle device for a vehicle for opening a lock of a vehicle door, and the pivoting body is a door handle with a handle section which can be grasped manually, and the holder can be attached to a vehicle door such that the handle section is pivotable in relation to the vehicle door.

This security is particularly advantageous in the case of a door handle device since the user actively pulls or presses on the pivoting element and therefore undesirable forces can act on the snap fastening, which forces could otherwise release the snap fastening. The door handle device is particularly preferably an inside door handle device, i.e. a handle device to be actuated manually on the inside of a vehicle door side. The door handle preferably has a suitable connection to the door lock, for example via a Bowden cable or an electric switch. In this manner, the door lock can be unlocked and the vehicle door opened by pivoting the door handle.

In a further embodiment of the present invention, the articulated mounting has two bearing regions which are spaced apart from each other and are arranged coaxially with the pivot axis, wherein each bearing region has two articulation elements, namely a coaxial axial element and a coaxial recess assigned to the latter, wherein the axial elements are respectively in engagement with the recesses in the joined-together state of the pivoting device, wherein the engagement forms the snap fastening.

By this means, a configuration which is particularly robust and is simple in terms of design is provided. The axial elements may also be considered pivoting pins. The recess is preferably a circular, coaxial recess. In this description, unless otherwise stated, the term coaxial relates to the pivot axis. The axial elements are preferably directed outward and facing away from each other. The recesses preferably each have an opening inward, and said openings face one another. They preferably continue (i.e. it is possible to see therethrough).

In a further exemplary embodiment of the present invention, the axial elements are formed integrally with the holder or with the pivoting body.

By this means, simple production is provided. For example, manufacturing by means of injection molding is possible.

In a further exemplary embodiment of the present invention, at least one recess is surrounded by a region which has an outer wall having a surface which is oblique with respect to the pivot axis, wherein the outer wall faces that side from which the axial element, to which the recess is assigned, is brought up to the recess when the pivoting body and the holder are joined together by bringing the pivoting body and the holder together along a direction perpendicular to the pivot axis.

Simple joining together is thereby provided. By means of the oblique surface, the snap fastening is more easily brought into the open position thereof. The recess is preferably arranged in such a manner that it makes contact with the axial element, to which the recess is assigned, when the pivoting body and the holder are joined together by bringing the pivoting body and the holder together along a direction perpendicular to the pivot axis.

In a further exemplary embodiment of the present invention, a front end of at least one axial element, preferably of the two axial elements, has a flattened portion which is oblique with respect to the pivot axis, wherein the flattened portion faces that side from which the assigned recess is brought up to the axial element when the pivoting body and the holder are joined together by bringing the pivoting body and the holder together along a direction perpendicular to the pivot axis.

By this means, alternatively or additionally, simple joining-together is provided.

In a further exemplary embodiment of the present invention, the relative movement of the two articulation elements that is necessary for releasing the snap fastening is an axial relative movement between the axial element and the recess of each bearing region in a direction away from each other.

This provides a very robust snap fastening mounting since the closing/opening movement (relative movement) is perpendicular to the pivoting movement necessary subsequently for opening the door.

In a further exemplary embodiment of the present invention, the articulated mounting has a first articulation side and a second articulation side, and the relative movement of the two articulation elements that is necessary for releasing the snap fastening is an axial relative movement in a direction away from each other, and the blocking element is arranged on the first articulation side and, in the first angular position, is at a greater distance from a region of the second articulation side than in the second angular position.

A special realization of the blocking is thereby provided—since the distance in the second angular position is smaller, the movement clearance for the relative movement is also more limited. The first articulation side is preferably the handle side, and the second articulation side is the holder side—or vice versa.

In a further exemplary embodiment of the present invention, of the articulation elements of the articulated mounting, there is at least one articulation element which has greater axial elasticity in comparison to another articulation element, and said articulation element is arranged on the second articulation side.

By this means, the blocking element is arranged on the opposite side of the articulation mounting to that articulation element which can "bend" more easily. The blocking element can therefore carry out the function thereof particularly effectively. The two articulation elements of the second articulation side are preferably provided with greater elasticity than the articulation elements on the first articulation side. The corresponding articulation element has axial elasticity preferably by the fact that it is connected via a substantially vertically running holding element to the rest of the holder or to the rest of the pivoting body (depending on articulation side) and said holding element has axial elasticity (for example by being bendable).

In a further exemplary embodiment of the present invention, the second articulation side is fixed in position relative to the holder.

By this means, the articulation element (the articulation elements) which has (have) greater elasticity is (are) arranged on the holder side and not on the pivoting-body side. This has the advantage that the pivoting body can, by contrast, be of comparatively rigid design, which, for example, makes painting or chrome-plating of the pivoting body more durable.

In a further exemplary embodiment of the present invention, the articulation elements of the first articulation side are arranged or held axially on the outside and the articulation elements of the second articulation side are arranged or held axially on the inside, and, in the second angular position, the blocking element

- is located between the articulation elements of the second articulation side, and/or
- is located between holding elements of the articulation elements of the second articulation side, wherein the articulation elements are axially elastic on the holding elements by elastic deformation of the holding elements.

By this means, the blocking element can absorb the movement, which is to be blocked, of the articulation elements from two opposite sides, and therefore the relative movement is particularly effectively blocked in the second angular position.

"Between" is preferably understood here as meaning "axially between".

In a further exemplary embodiment of the present invention, the blocking element is formed integrally with the holder or with the pivoting body.

By this means, simple production, for example by injection molding, is possible.

In a further exemplary embodiment of the present invention, the blocking element is a rib of the holder or of the pivoting body, which rib is substantially parallel to the pivot axis.

In this form, the blocking element is realized in as material-saving a manner as possible, but nevertheless in a manner highly capable of force absorption, in particular in the axial direction.

The object is furthermore achieved in particular by use of a pivoting device according to the invention (for example (inside) door handle device) in a motor vehicle, which is preferably understood as meaning production explicitly for the purpose of use in a vehicle and particularly preferably fitting such a device into a vehicle.

Figure 1B:
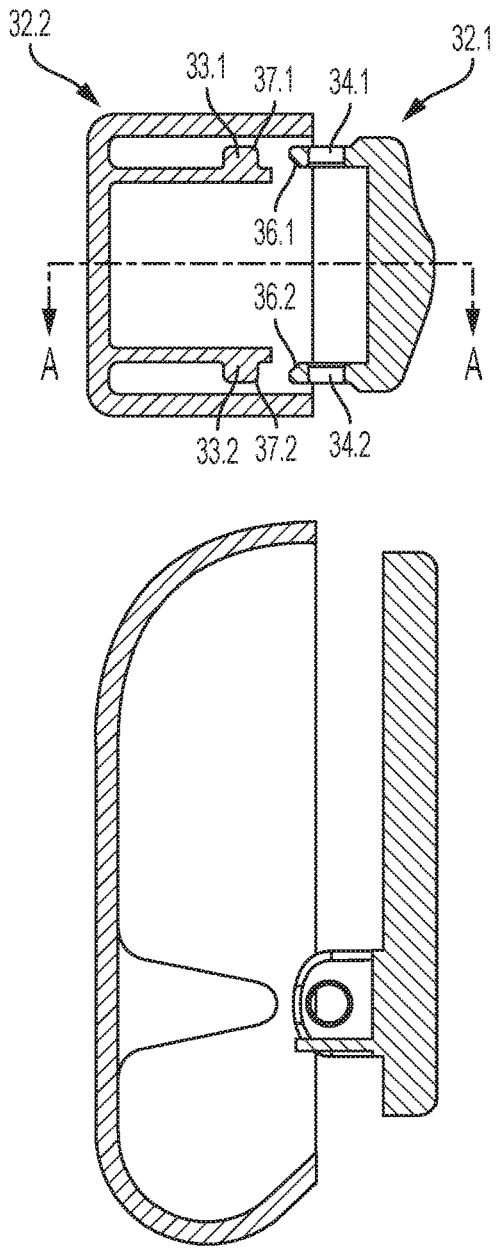
Figure 1C:
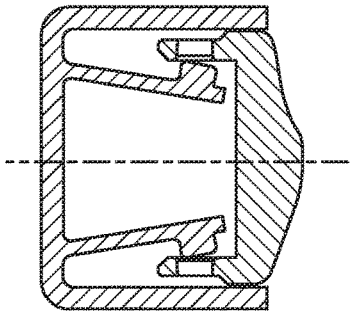
Figure 1D:
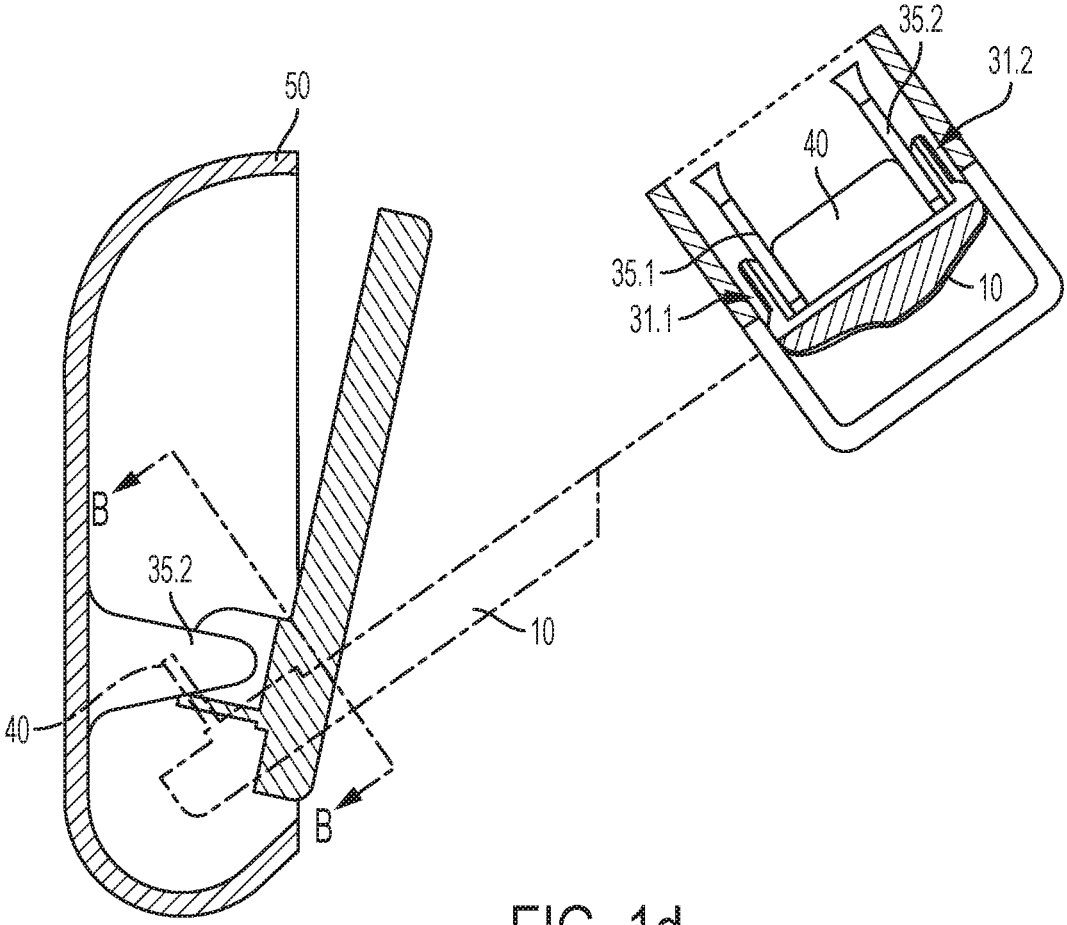
Figure 2A:
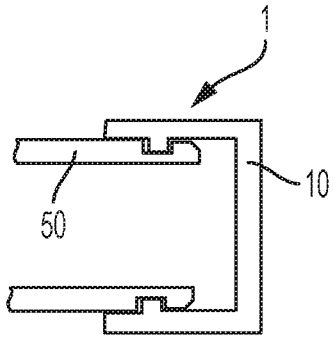
Figure 2B:
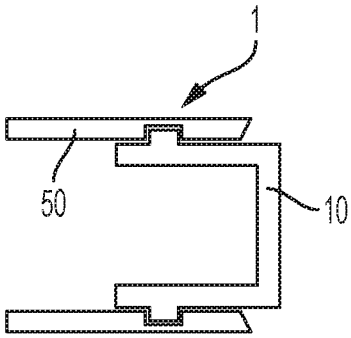
Figure 2C:
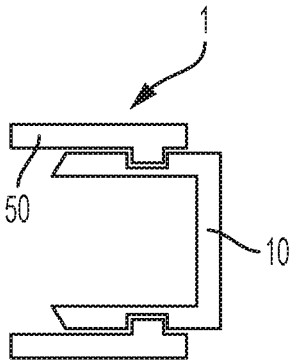
Figure 3:
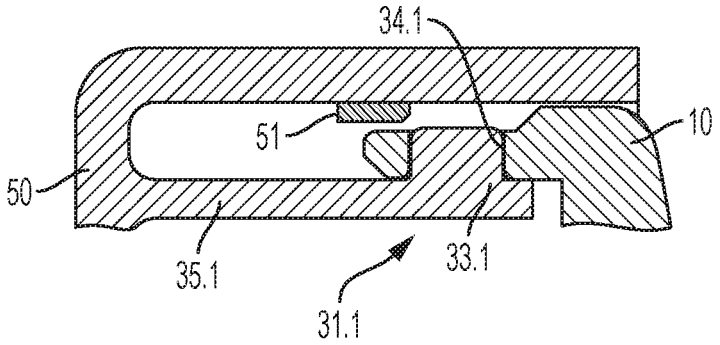

The invention will now be illustrated further by way of example with reference to drawings, in which:

FIG. 1*a*-1*d* show a particularly advantageous configuration of a pivoting device according to the invention, FIGS. 2*a*-2*c* show examples of alternative articulation realizations, FIG. 3 shows a further advantageous feature on a device, partially illustrated, according to FIGS. 1*a* to 1*d*.

For the sake of clarity, identical parts or repeating parts which can clearly be recognized are sometimes not marked again by reference signs in the drawing.

FIGS. 1*a*-1*d* show a particularly advantageous configuration of a pivoting device 1 according to the invention. FIG. 1*a* at the top is a vertical section, FIG. 1*a* at the bottom is a section A-A from the configuration shown thereabove. The same applies to FIG. 1*b*. FIG. 1*c* shows only the vertical section. FIG. 1*d* shows at the top right a vertical section along B-B from the horizontal sectional image from the bottom left, wherein two different angular positions of the pivoting body 10 are shown here, and the vertical sectional image at the top right relates to the position (indicated by dashed lines) of the pivoting body 10. FIG. 1*a* shows the assembled state, FIG. 1*b* shows the state prior to the joining-together, FIG. 1*c* show the state during the joining-together, shortly before the snap fastening locks. In FIGS. 1*a*-*c*, the pivoting body 10 is in the first angular position, in FIG. 1*d* the second angular region is indicated by way of example by the two angular positions shown.

The embodiment shown in these figures is a pivoting device 1 for a vehicle for opening a lock of a vehicle door. The device 1 has a pivoting body 10 with a handle section 11 which is to be grasped manually. The handle section 11 is mounted on a holder 50 of the pivoting device 1, which holder is to be attached to the vehicle door, via an articulated mounting 31 so as to be pivotable about a pivot axis 12. The pivoting body 10 and the holder 50 are held together on the articulated mounting 31 by means of a snap fastening between at least two articulation elements 33.1, 33.2, 34.1, 34.2 of the articulated mounting 31, which is the case in FIG. 1*a* and FIG. 1*d*. The pivoting device 1 has a blocking element 40. A closing or release of the snap fastening is possible in a first angular position of the pivoting body 10 in relation to the holder 50, FIGS. 1*a*-*c*. The closing or release of the snap fastening is blocked in a second angular position, FIG. 1*d*, by a relative movement of the two articulation elements 33.1, 33.2, 34.1, 34.2 being blocked in a form-fitting manner by the blocking element 40, which relative movement is necessary for releasing the snap fastening. In this case, there are in each case two angular regions, within which a blocking is present and is not present. In FIG. 1*d*, a relative movement is blocked in the two angular positions shown and therebetween. The articulated mounting 31 has two bearing regions 31.1, 31.2 which are spaced apart from each other and are arranged coaxially with the pivot axis 12, wherein each bearing region 31.1, 31.2 has two articulation elements 33.1, 34.1, 33.2, 34.2, namely a coaxial axial element 33.1, 33.2 and a coaxial recess 34.1, 34.2 assigned to the latter. The axial elements 33.1, 33.2 are respectively in engagement with the recesses 34.1, 34.2 in the joined-together state of the pivoting device 1, wherein the engagement forms the snap fastening. The axial elements 33.1, 33.2 are formed integrally with the holder 50. The two recesses 34.1, 34.2 are each surrounded by a region which has an outer wall 36.1, 36.2 having a surface which is oblique with respect to the pivot axis 12. The outer wall 36.1, 36.2 in each case faces that side from which the axial element 33.1, 33.2, to which the recess 34.1, 34.2 is assigned, is brought up to the recess 34.1, 34.2 when the pivoting body 10 and the holder 50 are joined together by bringing the pivoting body 10 and the holder 50 together along a direction perpendicular to the pivot axis 12, see FIG. 1*b*. A respective front end of the two axial elements 33.1, 33.2 has a flattened portion 37.1, 37.2 which is oblique with respect to the pivot axis 12, wherein the flattened portion 37.1, 37.2 faces that side from which the assigned recess 34.1, 34.2 is brought up to the axial element 33.1, 33.2 when the pivoting body 10 and the holder 50 are joined together by bringing the pivoting body 10 and the holder 50 together along a direction perpendicular to the pivot axis 12, see FIG. 1*b*. The relative movement of the two articulation elements 33.1, 33.2, 34.1, 34.2 in each case that is necessary for releasing the snap fastening is an axial relative movement between the axial element 33.1, 33.2 and the recess 34.1, 34.2 of each bearing region 31.1, 31.2 in a direction away from each other. The articulated mounting 31 has a first articulation side 32.1 and a second articulation side 32.2. The blocking element 40 is arranged on the first articulation side 32.1 and, in the first angular position, is at a greater distance from a region of the second articulation side 32.2 than in the second angular position. Of the articulation elements 33.1, 33.2, 34.1, 34.2 of the articulated mounting 31, two articulation elements 33.1, 33.2 have greater axial elasticity in comparison to the other articulation elements 34.1, 34.2. Said articulation elements 33.1, 33.2 are arranged on the second articulation side 32.2. The second articulation side 32.2 is fixed in position relative to the holder 50. The articulation elements 34.1, 34.2 of the first articulation side 32.1 are held axially on the outside and the articulation elements 33.1, 33.2 of the second articulation side 32.2 are held axially on the inside. In the second angular position, FIG. 1*d*, the blocking element 40 is located between the articulation elements 33.1, 33.2 of the second articulation side 32.2 and, as it were, between holding elements 35.1, 35.2 of the articulation elements 33.1, 33.2 of the second articulation side 32.2. The articulation elements 33.1, 33.2 are axially elastic on the holding elements 35.1, 35.2 by elastic deformation of the holding elements 35.1, 35.2. The blocking element 40 is formed integrally with the pivoting body 10. The blocking element 40 is a rib of the pivoting body 10, which rib is substantially parallel to the pivot axis 12. Said pivoting device 1 is preferably a door handle device for a vehicle for opening a lock of a vehicle door, and the pivoting body 10 is a door handle with a handle section 11 which is to be grasped manually, and the holder 50 can be attached to a vehicle door, and therefore the handle section 11 is pivotable in relation to the vehicle door.

For installation, the pivoting body 10 is brought together with the holder 50 from a position shown in FIG. 1*b* and in the first angular position or in the first angular region, wherein the holding elements 35.1, 35.2 in particular are elastically deformed with respect to each other, see FIG. 1*c*, until the articulation elements finally intermesh and snap back again into the inoperative position. If the pivoting body 10 is then pivoted into the second angular position or the second angular region, the blocking element 40 blocks a possible bending of the holding elements 35.1, 35.2 or articulation elements 33.1, 33.2 with respect to each other, and therefore the snap engagement cannot even be released unintentionally, for example by possible tilting.

The articulation elements 33.1, 33.2 of the second articulation side 32.2 are axial elements here and the articulation elements 34.1, 34.2 of the first articulation side 32.1 are recesses here. The axial elements 33.1, 33.2 are directed outward and face away from each other. The recesses 34.1, 34.2 each have an opening inward, and said openings face each other. In addition, said openings are continuous here.

FIGS. 2*a*-2*c* show in detail examples of alternative articulation realizations or assignments and orientations of articulation element types to articulation sides. In FIG. 2*a*, axial elements are arranged on the pivoting body 10 and recesses are arranged on the holder 50, wherein the axial elements face one another (by the front ends thereof). In contrast to FIG. 2*a*, in FIG. 2*b*, the axial elements face away from one another. In FIG. 2*c*, an assignment as in the embodiment in FIGS. 1*a*-*d* is provided, but the axial elements face one another here. In addition, further variations are possible, for example an axial element and a recess on one articulation side (for example on the holder side) with a precisely opposite arrangement of recess and axial element on the other articulation side.

FIG. 3 shows a further advantageous feature on a device, illustrated by way of a detail, according to FIGS. 1*a* to 1*d*. The holder-side articulation side (holder side) has a mating surface 51 which, in the assembled state of the device 1, is arranged axially next to the articulation element 34.1 of the pivoting-body-side articulation side (pivoting-body side). The articulation element 34.1 of the pivoting-body side is therefore arranged axially between the mating surface 51 and the holding element 35.1 of the articulation element 33.1 of the holder side. The mating surface 51 permits less axial clearance for the articulation element 34.1 of the pivoting-body side than is necessary for release of the snap fastening by an axial movement of the articulation element 34.1 of the pivoting-body side. This provides security against, for example, bending of the pivoting-body side, and therefore the necessary movement for opening/closing the snap fastening is undertaken substantially only on the holder side. In addition, the mating surface 51 is designed in the form of a projection. The projection is preferably arranged behind the holder-side articulation element 33.1, as seen from the side from which the pivoting body 10 is brought up to the holder 50 in order to join together the snap fastening. By this means, an aid for introduction of the pivoting body 10 into the holder 50 is provided by the projection. The second bearing region 31.2 is preferably configured analogously.

With this invention, an easy-to-install pivoting body has been provided with simple means and, in addition, is securely held in the bearing thereof. This is achieved by a snap mechanism in combination with a blocking element, wherein the blocking element permits an installation position in which the snap mechanism can be joined together, but otherwise mechanically prevents opening of the snap mechanism.

LIST OF REFERENCE SIGNS

1 Pivoting device
10 Pivoting body
11 Handle section
12 Pivot axis
31 Articulation bearing
31.1 First bearing region
31.2 Second bearing region
32.1 First articulation side
32.2 Second articulation side
33.1 Coaxial axial element
33.2 Coaxial axial element
34.1 Coaxial recess
34.2 Coaxial recess
35.1 Holding element
35.2 Holding element
36.1 Outer wall
36.2 Outer wall
37.1 Flattened portion
37.2 Flattened portion
40 Blocking element
50 Holder
51 Mating surface

The invention claimed is:

1. A pivoting device (1) for a motor vehicle, comprising: a holder (50) and a pivoting body (10) which is mounted on the holder (50) via an articulated mounting (31) so as to be pivotable about a pivot axis (12) between a first angular position relative to the holder (50) and a second angular position relative to the holder (50), wherein the pivoting body (10) and the holder (50) are releasably held together on the articulated mounting (31) by means of a snap fastening between at least two articulation elements (33.1, 33.2, 34.1, 34.2) of the articulated mounting (31), and the pivoting body (10) has a blocking element (40), wherein, in the first angular position of the pivoting body (10), the blocking element (40) permits a release of the snap fastening to permit removal of the pivoting body (10) from the holder (50), wherein, in the second angular position of the pivoting body (10), the blocking element (40) blocks the release of the snap fastening by a relative movement of the two articulation elements (33.1, 33.2, 34.1, 34.2) being blocked in a form-fitting manner by the blocking element (40), which relative movement is necessary for releasing the snap fastening.

2. The pivoting device (1) as claimed in claim 1, wherein the pivoting device (1) is a door handle device for a vehicle for opening a lock of a vehicle door, and wherein the pivoting body (10) is a door handle with a handle section (11) which can be grasped manually, and wherein the holder (50) can be attached to a vehicle door such that the handle section (11) is pivotable in relation to the vehicle door.

3. The pivoting device (1) as claimed in claim 1, wherein the articulated mounting (31) has two bearing regions (31.1, 31.2) which are spaced apart from each other and are arranged coaxially with the pivot axis (12), wherein each bearing region (31.1, 31.2) has two articulation elements (33.1, 34.1, 33.2, 34.2), namely a coaxial axial element (33.1, 33.2) and a coaxial recess (34.1, 34.2) assigned to the latter, wherein the axial elements (33.1, 33.2) are respectively in engagement with the recesses (34.1, 34.2), wherein the engagement forms the snap fastening.

4. The pivoting device (1) as claimed in claim 3, wherein the axial elements (33.1, 33.2) are formed integrally with the pivoting body (10).

5. The pivoting device (1) as claimed in claim 3, wherein at least one recess (34.1, 34.2) is surrounded by a region which has an outer wall (36.1, 36.2) having a surface which is oblique with respect to the pivot axis (12).

6. The pivoting device (1) as claimed in claim 3, wherein a front end of at least one axial element (33.1, 33.2) has a flattened portion (37.1, 37.2) which is oblique with respect to the pivot axis (12).

7. The pivoting device (1) as claimed in claim 3, wherein the relative movement of the two articulation elements (33.1, 33.2, 34.1, 34.2) that is necessary for releasing the snap fastening is an axial relative movement between the axial element (33.1, 33.2) and the recess (34.1, 34.2) of each bearing region (31.1, 31.2) in a direction away from each other.

8. The pivoting device (1) as claimed in claim 1, wherein the articulated mounting (31) has a first articulation side (32.1) and a second articulation side (32.2), and wherein the relative movement of the two articulation elements (33.1, 33.2, 34.1, 34.2) that is necessary for releasing the snap fastening is an axial relative movement in a direction away from each other, and the blocking element (40) is arranged on the first articulation side (32.1) and, in the first angular position, is at a greater distance from a region of the second articulation side (32.2) than in the second angular position.

9. The pivoting device (1) as claimed in claim 8, wherein, of the articulation elements (33.1, 33.2, 34.1, 34.2) of the articulated mounting (31), there is at least one articulation element (33.1, 33.2) which has greater axial elasticity in comparison to another articulation element (34.1, 34.2), and wherein said at least one articulation element (33.1, 33.2) is arranged on the second articulation side (32.2).

10. The pivoting device (1) as claimed in claim 9, wherein the second articulation side (32.2) is fixed in position relative to the holder (50).

11. The pivoting device (1) as claimed in claim 8, wherein the articulation elements (34.1, 34.2) of the first articulation side (32.1) are arranged or held axially on the outside and the articulation elements (33.1, 33.2) of the second articulation side (32.2) are arranged or held axially on the inside, and wherein, in the second angular position, the blocking element (40)

is located between the articulation elements (33.1, 33.2) of the second articulation side (32.2), and/or is located between holding elements (35.1, 35.2) of the articulation elements (33.1, 33.2) of the second articulation side (32.2), wherein the articulation elements (33.1, 33.2) are axially elastic on the holding elements (35.1, 35.2) by elastic deformation of the holding elements (35.1, 35.2).

12. The pivoting device (1) as claimed in claim 1, wherein the blocking element (40) is formed integrally with the pivoting body (10).

13. The pivoting device (1) as claimed in claim 1, wherein the blocking element (40) is a rib of the holder (50) or of the pivoting body (10), which rib is substantially parallel to the pivot axis (12).

14. The use of a pivoting device (1) as claimed in claim 1 in a motor vehicle.

15. A pivoting device for a motor vehicle, comprising:

a holder and a pivoting body mounted on the holder via an articulated mounting so as to be pivotable about a pivot axis between a first angular position relative to the holder and a second angular position relative to the holder, wherein the pivoting body and the holder are held together on the articulated mounting by a snap fastening between at least two articulation elements of the articulated mounting, wherein the pivoting body has a blocking element, wherein, in the first angular position of the pivoting body relative to the holder, the blocking element is positioned to permit a release of the snap fastening, wherein, in the second angular position of the pivoting body relative to the holder, the blocking element blocks the release of the snap fasting by a relative movement of the two articulation elements being blocked in a form-fitting manner by the blocking element;

wherein the blocking element is located on the pivoting body such that an angular position of the blocking element relative to at least one of the two articulation elements varies as between the first angular position of the pivoting body and the second angular position of the pivoting body.

16. The pivoting device as claimed in claim 15, wherein the pivoting device comprises a door handle device for a vehicle for opening a lock of a vehicle door, and wherein the pivoting body is the door handle with a handle section that can be grasped manually, and wherein the holder is configured to be attached to a vehicle door such that the handle section is pivotable in relation to the vehicle door.

17. The pivoting device as claimed in claim 15, wherein the articulated mounting has two bearing regions that are spaced apart from each other and that are arranged coaxially with the pivot axis, wherein each bearing region has two articulation elements comprising a coaxial axial element and a coaxial recess, wherein the axial elements are respectively in engagement with the recesses in a joined-together state of the pivoting device, wherein the engagement forms the snap fastening.

18. The pivoting device as claimed in claim 15, wherein the blocking element is located on the pivoting body and pivots with the pivoting body.

19. The pivoting device as claimed in claim 15, wherein, in the first angular position, the pivoting body lies adjacent the holder, wherein, in the second angular position, an end of the pivoting body extends outward and away from the holder.

20. A pivoting device for a motor vehicle, comprising:

a holder and a pivoting body mounted on the holder via an articulated mounting so as to be pivotable about a pivot axis between a first angular position relative to the holder and a second angular position relative to the holder, wherein the pivoting body and the holder are held together on the articulated mounting by a snap fastening between at least two articulation elements of the articulated mounting, wherein the pivoting body has a blocking element, wherein, in the first angular position of the pivoting body relative to the holder, the blocking element is positioned to permit a release of the snap fastening, wherein, in the second angular position of the pivoting body relative to the holder, the blocking element blocks the release of the snap fasting by a relative-movement of the two articulation elements being blocked in a form-fitting manner by the blocking element;

wherein the blocking element is retained on the pivoting body both when the pivoting body is in the first angular position and when the pivoting body is in the second angular position.

* * * * *